US009464495B2

(12) United States Patent
Picciotti et al.

(10) Patent No.: US 9,464,495 B2
(45) Date of Patent: Oct. 11, 2016

(54) POWER CHARGE RETENTION AND CENTRALIZING DEVICE FOR A WIRELINE PRESSURE SETTING ASSEMBLY

(71) Applicant: Baker Hughes Incorporated, Houston, TX (US)

(72) Inventors: Chad H. Picciotti, Cypress, TX (US); Kent S. Meyer, Spring, TX (US); Joesph A. Guthrie, Hampton, AR (US)

(73) Assignee: Baker Hughes Incorporated, Houston, TX (US)

( * ) Notice: Subject to any disclaimer, the term of this patent is extended or adjusted under 35 U.S.C. 154(b) by 514 days.

(21) Appl. No.: 13/901,292

(22) Filed: May 23, 2013

(65) Prior Publication Data

US 2014/0345847 A1 Nov. 27, 2014

(51) Int. Cl.
*E21B 23/04* (2006.01)

(52) U.S. Cl.
CPC ..... *E21B 23/04* (2013.01)

(58) Field of Classification Search
CPC combination set(s) only.
See application file for complete search history.

(56) References Cited

U.S. PATENT DOCUMENTS 2,695,064 A * 11/1954 Ragan ..... E21B 23/065 166/120
3,024,843 A * 3/1962 Hanes ..... E21B 23/065 166/120
2005/0211429 A1 9/2005 Gray et al.
2009/0223659 A1 9/2009 Hill et al.
2009/0223714 A1 9/2009 Hill et al.
2011/0308797 A1 12/2011 Umphries et al.
2012/0024528 A1 2/2012 Mytopher et al.
2012/0216701 A1* 8/2012 Streibich ..... C06B 33/02 102/531

* cited by examiner

*Primary Examiner* — David Andrews
*Assistant Examiner* — Ronald Runyan
(74) *Attorney, Agent, or Firm* — Steve Rosenblatt

(57) ABSTRACT

The power charge of a wireline pressure setting assembly includes a barrier located adjacent an open upper end of the power charge. The barrier centralizes the power charge in horizontal applications to ensure the associated tool properly sets. The barrier also limits how much of the power charge can flow out of its housing in a horizontal application. The barrier can be porous or impervious to contain as much of the power charge in a small sub-chamber in the pressure chamber defined by the barrier. Once ignition starts in the power charge the barrier can be consumed or otherwise disabled for the normal functioning of the setting device to set a tool and release from the set tool in a normal manner.

28 Claims, 1 Drawing Sheet

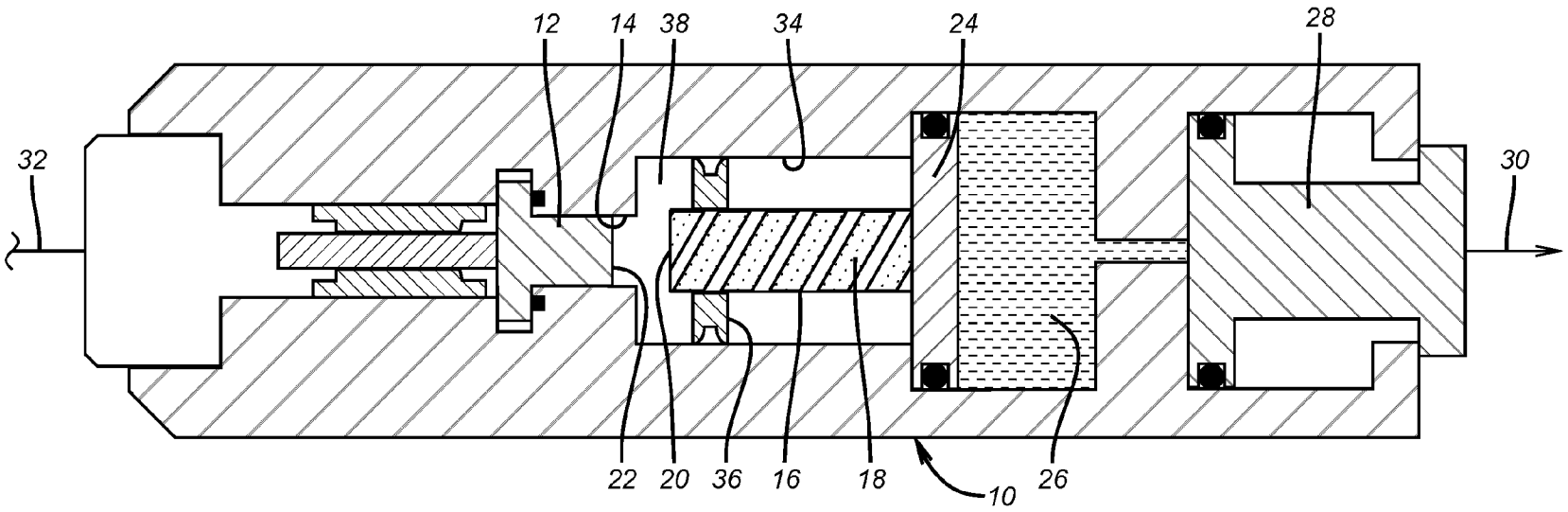
30
28
26
10
24
18
34
16
36
38
20
14
22
12
32

POWER CHARGE RETENTION AND CENTRALIZING DEVICE FOR A WIRELINE PRESSURE SETTING ASSEMBLY

FIELD OF THE INVENTION

The field of the invention is wireline pressure setting assemblies and more particularly configurations thereof that enhance performance in horizontal application with features that focus on orientation and configuration of the power charge.

BACKGROUND OF THE INVENTION

When a power charge that is used in a Wireline Pressure Setting Assembly (WLPSA) is subject to temperatures of 120 F or higher the material starts to lose its viscidity (property of being cohesive and sticky) and becomes more semifluid in consistency or, with some power charge material, it starts to froth up and expand. In vertical applications/wellbores this doesn't seem to be as much of a concern because the cartridge used to contain the power charge material stands upright (vertical) and the material doesn't have a chance to escape its cartridge. This may not be the case in horizontal or deviated applications/wellbores where the power charge is lying flat (horizontal) or at an angle, where the material has an opportunity to flow out of the cartridge and into the pressure chamber. This act may decrease the probability of getting an ignition of the power charge material and may affect the burn rate that is used to create pressure that the WLPSA needs to function correctly. In addition to the above, when a power charge is used in a horizontal or deviated application/wellbore it positions itself on the low side of the pressure chamber. This position may not be ideal for the best probability of ignition from an igniter source. Based on the two scenarios mentioned, a mechanism or mechanisms are needed and provided by the present invention to centralize the power charge in the pressure chamber, allow for the management of the material that may flow into the pressure chamber, and allows pressure to bypass the mechanism(s) to properly function the WLPSA either by vents of some description or the ability to disintegrate.

The present invention envisions placing a porous or breakable barrier at the top and around a power charge before placed in the pressure chamber of a WLPSA to centralize the power charge in the pressure chamber. Once the barrier is placed on/around the power charge, the power charge is inserted into the pressure chamber of the WLPSA and the outside diameter of the barrier has full contact with the inside diameter of the pressure chamber of the WLPSA so the power charge material can't materially flow past it. The rest of the WLPSA is assembled and deployed as recommended by the manufacturer. Once the power charge is ignited the mechanism would be able to transmit pressure through it using vents or it can be allowed to disintegrate or otherwise fail.

Typical of the tools discussed above that is a candidate for the present invention is the E-4 Wireline Setting Tool that has been offered by Baker Hughes for decades. It will be used for context for the invention while those skilled in the art will appreciate that other devices that have similar issues in horizontal applications can also benefit from the present invention. Additional details of the invention can be obtained from the detailed description of the preferred embodiment and the associated drawing while realizing that the full scope of the invention is determined by the appended claims.

SUMMARY OF THE INVENTION

The power charge of a wireline pressure setting assembly includes a barrier located adjacent an open upper end of the power charge. The barrier centralizes the power charge in horizontal applications to ensure the associated tool properly sets. The barrier also limits how much of the power charge can flow out of its housing in a horizontal application. The barrier can be porous or impervious to contain as much of the power charge in a small sub-chamber in the pressure chamber defined by the barrier. Once ignition starts in the power charge the barrier can be consumed or otherwise disabled for the normal functioning of the setting device to set a tool and release from the set tool in a normal manner.

BRIEF DESCRIPTION OF THE DRAWING

The FIGURE shows the barrier in position around a power charge before ignition in a section view that is schematic.

DETAILED DESCRIPTION OF THE PREFERRED EMBODIMENT

The FIG. shows a part of a housing 10 of an E-4 wireline pressure setting assembly (WLPSA) that has an igniter assembly 12 that may be one or more components such as a primary and a secondary igniter and that is held firm in bore 14 of the housing 10. A housing 16 holds the power charge 18 therein and has an open top 20 that is spaced apart from the lower end 22 of the open top 20. Setting off the power charge 18 generates gas pressure from ignition that propels the floating piston 24, which serves as a first support for housing 16, to displace fluid 26 against piston 28 to set the tool that is not shown and to release from the tool as well. Arrow 30 schematically illustrates the movement of the piston 28 to set the tool that is not shown and to release from it. Wireline 32 supports the setting tool body 10 and is used to initiate the setting by actuation of the igniter assembly 12.

What has been described thus far are the components of the E-4 WLPSA and at this time it is worth mentioning why the tool has functioned well in vertical well applications but not as predictably in horizontal applications. One reason is that the housing 16 due to the clearance to the igniter assembly 12 lower end 22 has a tendency to tip to contact the side of the chamber 34 which puts its open top 20 laterally askew from the line of fire of the igniter assembly 12. This offset potential could affect the way the power charge burns and generates gas to a point where the amount of pressure generated will be insufficient to fully set the tool in what is referred to as a soft set or there may be issues in the release function that happens after setting with this tool.

Another issue in using these tools is the temperature effect on the power charge 18. At temperatures typically seen in deeper wells of about 350 degrees F., the power charge 18 will start to change state and become more likely to flow. Thus apart from the clearance in the chamber 34 around the housing 16 for the power charge 18 that can allow the housing 16 to skew and let some of the power charge 18 escape the housing 16 there is the added risk that the already skewed housing 16 with its open top 20 will enable more of the power charge 18 to flow unchecked in the chamber 34. This can mean that not all the power charge 18 will fire as desired leaving open the chance for a soft set for the tool or a failure to release from the soft set tool that is not shown.

The present invention seeks to address these concerns with an annularly shaped member 36 that is fitted around the housing 16 and extends to the wall that defines the chamber 34. In that sense one of the functions of the second support member 36 is to act as a centralizer for the housing 16 to maintain the alignment of the housing 16 with respect to the igniter assembly 12 so that the power charge 18 will burn as needed to generate the appropriate gas pressure to set the tool firmly and effectively release from the tool after the set. Ideally the member 36 should be placed as close to the open end 20 of the housing 16 as possible to reduce the volume of sub-chamber 38. The reason for this is that in horizontal or less than vertical bores subjected to high borehole temperatures, the power charge 18 can become more flowable and exit the housing 16. In an effort to retain as much of the power charge 18 in the housing 16 minimizing the volume of the sub-chamber 38 the placement of the member 36 as close to the open top 20 is the simplest way to ensure a more complete ignition of the power charge 18 so that the desired setting and release pressures are generated within the tool.

Another feature of the member 36 is that it needs to fail as the ignition and pressure generation begins to ensure that the pistons 24 and 28 move rapidly to set and then release from the tool being set, such as a packer, for example. The member 36 can be made of a variety of materials such as cardboard, plastic, rubber or other non-metallic materials. Other single or combination of materials can be employed that disintegrate or burn or otherwise fail at the outset of the ignition or the pressure development process that ensues. Alternatively, the member can have an opening or openings that are small enough to let it pass gas but retain the power charge 18 from getting past it before ignition. Once ignition starts, the member 36 can have the openings serve as failure lines in a breakup of the member or the entire member can fail in the manners that are described above.

Alternative placements and embodiments are contemplated. For example to contain the power charge 18 in the housing 16 the member 36 can instead be placed over the open top 20 and it can be made of a wire mesh screen material that will pass gas but retain the power charge 18 in the housing 16. Since a screen material can pass gas the need to have the screen fail as gas is generated is reduced if not eliminated. Additionally, since the screen can pass gas and doesn't necessarily have to fail, metallic materials now become a viable option as well as non-metallic materials. The screen can be supported from housing 16 or from the wall of chamber 34 while in contact with the top 20 of the housing 16 to serve both as an alignment device and as a retention device for the power charge 18.

Those skilled in the art will appreciate that the present invention provides an added measure of operational reliability to wireline run setting tools that ignite a power charge to create pressure that ultimately sets and releases from a subterranean tool such as a packer or other types of tools. The added device has dual benefit of centralizing the power charge and of minimizing the amount of leakage out of a housing for the power charge in other than vertical wellbores. As explained the size of the chamber around the housing 18 and the gap to the igniter assembly 12 allows the housing 16 to skew against the chamber wall 34 that needs to be a predetermined size to provide the needed force to accelerate piston 24 to get the setting and release of the downhole tool accomplished.

The above description is illustrative of the preferred embodiment and many modifications may be made by those skilled in the art without departing from the invention whose scope is to be determined from the literal and equivalent scope of the claims below:

We claim:

1. In a setting tool assembly that generates setting pressure to set and release from a borehole tool with ignition of a power charge that drives a piston assembly, the improvement comprising:

a first support for a structural housing that contains the power charge to support the weight of said structural housing and said power charge;

a second support for said structural housing that contains said power charge, said second support disposed within a surrounding body in an annular open space between said structural housing and said body and spaced from said first support, said second support stabilizes said structural housing in deviated wellbores to maintain general alignment of said structural housing with an ignition assembly across an open gap until the power charge is ignited.

2. The assembly of claim 1, wherein:

said second support is disposed in said annular open space about said structural housing and is mounted mounting to an outer surface of said structural housing.

3. The assembly of claim 1, wherein:

said second support subdivides said annular open space into two sub-chambers and is located closer to an open end of said structural housing than an opposite end of said structural housing.

4. The assembly of claim 3, wherein:

said second support limits the amount of said power charge that can escape from said open end of said structural housing due to borehole deviation or thermal effects from the borehole on said power charge.

5. The assembly of claim 4, wherein:

said second support is impervious to flow of said power charge therethrough.

6. The assembly of claim 4, wherein:

said second support is made of a non-metallic material.

7. The assembly of claim 6, wherein:

said second support is made of one or more of a material consisting of cardboard, plastic, and rubber.

8. The assembly of claim 4, wherein:

said second support is burned on ignition of said power charge.

9. The assembly of claim 4, wherein:

said second support structurally fails on ignition of said power charge.

10. The assembly of claim 3, wherein:

said second support is located at an open end of said structural housing.

11. The assembly of claim 1, wherein:

said second support divides said annular open space into two sub-chambers such that a smaller sub-chamber is disposed around said power charge adjacent an open top for said structural housing.

12. The assembly of claim 11, wherein:

said second support limits the amount of said power charge that can escape from said open end of said structural housing due to borehole deviation or thermal effects from the borehole on said power charge.

13. The assembly of claim 12, wherein:

said second support is impervious to flow of said power charge therethrough.

14. The assembly of claim 12, wherein:

said second support is made of a non-metallic material.

15. The assembly of claim 14, wherein:

said second support is made of one or more of a material consisting of cardboard, plastic, and rubber.

16. The assembly of claim 12, wherein:

said second support is burned on ignition of said power charge.

17. The assembly of claim 12, wherein:

said second support structurally fails on ignition of said power charge.

18. The assembly of claim 12, wherein:

said second support stabilizes said structural housing in deviated wellbores to maintain general alignment of said structural housing with an ignition assembly until the power charge is ignited.

19. In a setting tool assembly that generates setting pressure to set and release from a borehole tool with ignition of a power charge that drives a piston assembly, the improvement comprising:

a support for a structural housing that contains the power charge, said support disposed within a surrounding body in an annular open space between said structural housing and said body that stabilizes said structural housing in deviated wellbores to maintain general alignment of said structural housing with an ignition assembly across an open gap until the power charge is ignited;

said support subdivides said annular open space into two sub-chambers and is located closer to an open end of said structural housing than an opposite end of said structural housing;

said support limits the amount of said power charge that can escape from said open end of said structural housing due to borehole deviation or thermal effects from the borehole on said power charge;

said support has one or more openings sized to hold back said power charge.

20. The assembly of claim 19, wherein:

said openings define a failure location for said support after said power charge is ignited.

21. In a setting tool assembly that generates setting pressure to set and release from a borehole tool with ignition of a power charge that drives a piston assembly, the improvement comprising:

a support for a structural housing that contains the power charge that is disposed in a surrounding chamber to said structural housing, said support defining an annular open space between said structural housing and a wall that defines said chamber for alignment of said structural housing with an igniter across an open space between said igniter and said structural housing, said support divides said annular open space into two sub-chambers such that a smaller sub-chamber is disposed about an open top for said structural housing;

said support limits the amount of said power charge that can escape from said open end of said structural housing due to borehole deviation or thermal effects from the borehole on said power charge;

said support has one or more openings sized to hold back said power charge.

22. The assembly of claim 21, wherein:

said openings define a failure location for said support after said power charge is ignited.

23. In a setting tool assembly that generates setting pressure to set and release from a borehole tool with ignition of a power charge that drives a piston assembly, the improvement comprising:

a support for a structural housing that contains the power charge, said support disposed within a surrounding body in an annular open space between said structural housing and said body that stabilizes said structural housing in deviated wellbores to maintain general alignment of said structural housing with an ignition assembly across an open gap until the power charge is ignited;

said support subdivides said annular open space into two sub-chambers and is located closer to an open end of said structural housing than an opposite end of said structural housing;

said support is located at an open end of said structural housing;

said support comprises a screen.

24. The assembly of claim 23, wherein:

said support retains structural integrity while passing gas generated by ignition of the power charge.

25. In a setting tool assembly that generates setting pressure to set and release from a borehole tool with ignition of a power charge that drives a piston assembly, the improvement comprising:

a porous retention device mounted around an open end of a structural housing for the power charge, to retain, before firing, the power charge in said structural housing in deviated wellbores for ignition thereof.

26. The assembly of claim 25, wherein:

said retention device comprises a screen.

27. The assembly of claim 26, wherein:

said screen maintains structural integrity after said power charge is ignited.

28. The assembly of claim 27, wherein:

said screen is a metallic or non-metallic wire mesh.

* * * * *